US005620395A

United States Patent [19]

Como

[11] Patent Number: 5,620,395

[45] Date of Patent: Apr. 15, 1997

[54] METHOD AND ASSOCIATED APPARATUS FOR INSTALLING AN ABOVE ICE SURFACE CURLING HACK

[76] Inventor: Raymond Como, Box 32, Riviere Qui Barre, Alberta, Canada, T0G 1Y0

[21] Appl. No.: 524,798

[22] Filed: Sep. 7, 1995

[51] Int. Cl.[6] ..... A63B 69/00

[52] U.S. Cl. ..... 482/19

[58] Field of Search ..... 482/19

[56] References Cited

U.S. PATENT DOCUMENTS

| | | | |
|---|---|---|---|
| 2,004,712 | 6/1935 | Niday | 403/226 |
| 2,505,784 | 5/1950 | Miller | 482/19 |
| 2,534,159 | 12/1950 | Brouwer et al. | 482/19 |
| 3,401,931 | 9/1968 | McCafferty et al. | 482/19 |
| 3,724,843 | 4/1973 | Fichter et al. | 482/19 X |
| 3,799,542 | 3/1974 | Potgieter | 482/19 |
| 4,089,519 | 5/1978 | Newton, Jr. | 482/19 |
| 4,561,650 | 12/1985 | Newton, Jr. | 482/19 |
| 5,465,964 | 11/1995 | Thompson | 273/126 R |

FOREIGN PATENT DOCUMENTS

| | | | |
|---|---|---|---|
| 2023342 | 2/1992 | Canada | A63B 67/14 |
| 2037190 | 9/1992 | Canada | A63B 71/00 |

*Primary Examiner*—Frank Tsay
*Attorney, Agent, or Firm*—Anthony R. Lambert

[57] ABSTRACT

A method of installing an above ice surface curling hack is described. Firstly, embed a base member into a sheet of ice. The base member must be totally covered by ice thereby leaving an ice surface that is devoid of any hack depressions. The base member has at least two vertically oriented female receptacles. Secondly, drill the ice out of the female receptacles. Thirdly, mate the female receptacles of the base member with depending male members of a detachable foot pad.

1 Claim, 1 Drawing Sheet

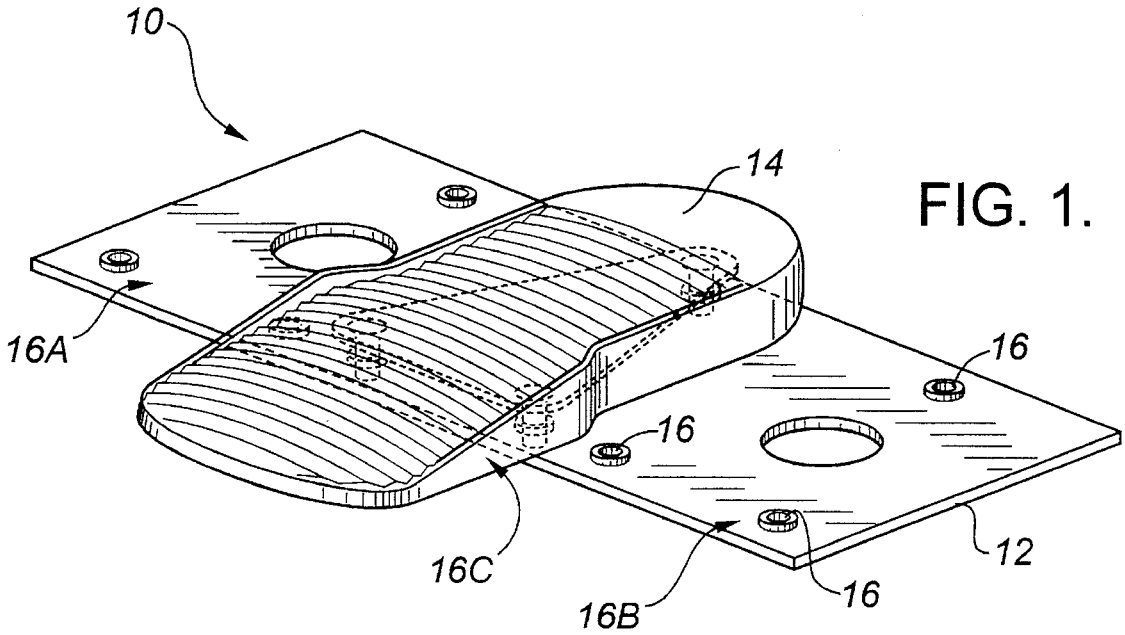
FIG. 1.
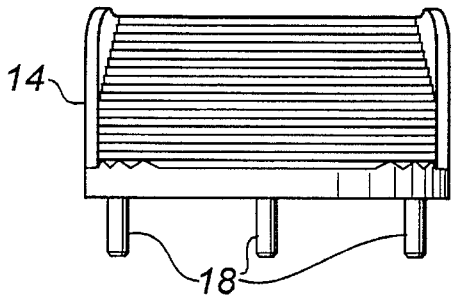
FIG. 2.
FIG. 3.
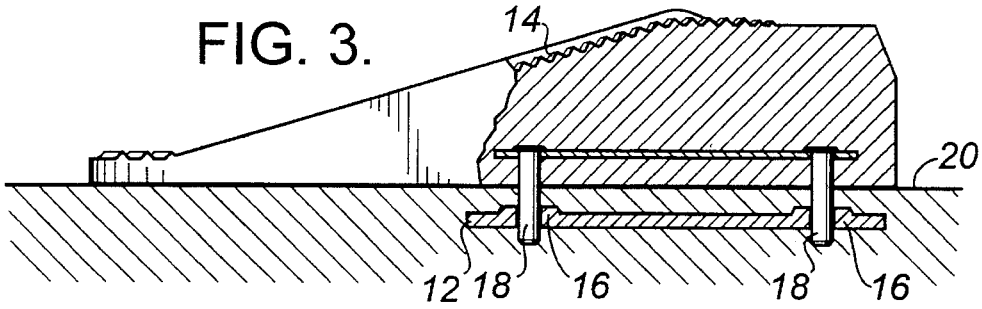

METHOD AND ASSOCIATED APPARATUS FOR INSTALLING AN ABOVE ICE SURFACE CURLING HACK

FIELD OF THE INVENTION

The present invention relates to a method and associated apparatus for installing an above ice surface curling hack.

BACKGROUND OF THE INVENTION

Historically, a curling hack consisted of a notch or depression carved in a sheet of ice. A curler would stand with one foot in the hack while throwing a curling rock. The hack provided the curler with stable footing when throwing the curling rock.

In modern curling the curler no longer stands when throwing the curling rock. Instead the curler slides part way down the sheet of ice with the curling rock. The curling hack is still important as it provides a point against which the curler can push to commence the slide.

Despite its importance to the game of curling, the conventional curling hack consisting of a notch or depression in the ice surface presents a number of problems. The persons who care for and maintain the ice surface must continually remove accumulations of broom straw and debris from the hacks. When "pebbling" the ice, they must take care not to allow ice to accumulate within the hack for fear that a curler may slip and fall while attempting to push out of the hack to commence his or her slide. During the playing of the game, the curlers must prevent curling rocks from falling into and potentially damaging the hacks. It is not unusual for a curler, while absorbed in watching the curling action, to inadvertently step down into the notch or depression forming the hack and fall or otherwise injure himself or herself.

In order to make caring for the ice easier above ice surface curling hacks have been developed that rest on top of the ice surface. These curling hacks consist of an arm having a first end pivotally mounted at an end of a sheet of curling ice and a second end having a foot pad. When the curlers wish to throw curling rocks, the arm is laid down parallel to the ice surface with the foot pad resting on the ice surface where a conventional hack would normally be. When the ice is being serviced, or when not required during a curling game, the arm is pivoted into a position raised from the ice surface. To accommodate both curlers who push off on their right foot and curlers who push off on their left foot, the arm is laterally slidable.

The concept of an above ice surface curling hack provided tremendous advantages and convenience for the persons servicing the ice. Numerous complaints, however, were received from the curlers. The mechanism that allowed the arm to move laterally, unavoidably developed some unwanted movement after prolonged use that adversely effected the curlers push off. In the raised position, the arm itself became a hazard which was often inadvertently bumped by curlers. For these and other reasons, the above ice surface curling hacks did not become popular with curlers.

SUMMARY OF THE INVENTION

What is required is better method of installing an above ice surface curling hack.

According to one aspect of the present invention there is provided a method of installing an above ice surface curling hack. The method includes the steps that will hereinafter be further described. Firstly, embed a base member into a sheet of ice. The base member must be totally covered by ice thereby leaving an ice surface that is devoid of any hack depressions. The base member has at least two vertically oriented female receptacles. Secondly, drill the ice out of the female receptacles. Thirdly, mate the female receptacles of the base member with depending male members of a detachable foot pad.

With the method, as described above, the drilled out holes are only slightly larger in diameter than a pencil. When the foot pad is removed there is absolutely no portion of the base upon which a curler can trip. There is, similarly, nothing upon which a curling rock can catch. When the hack is needed, the foot pad is quickly and simply placed in position by mating the depending male members of the foot pad with the female receptacles in the base. The foot pad provides the curler with an extremely stable foothold. Apart from having to periodically drill ice out of the females, the curling hack requires relatively little maintenance while gaining all the many benefits that an above ice surface curling hack provides to persons maintaining the curling ice.

According to another aspect of the invention there is provided an above ice surface curling hack which includes a base member having at least two vertically oriented female receptacles. A foot pad is provided which has at least two depending male members. The male members of the foot pad temporarily mate with the female receptacles of the base member to detachably secure the foot pad to the base.

BRIEF DESCRIPTION OF THE DRAWINGS

These and other features of the invention will become more apparent from the following description in which reference is made to the appended drawings, wherein:

FIG. 1 is a perspective view of a curling hack constructed in accordance with the teaching of the present invention.

FIG. 2 is a front elevation view of a foot pad component of the curling hack illustrated in FIG. 1.

FIG. 3 is a side elevation view in longitudinal section of the curling hack illustrated in FIG. 1, installed on a sheet of ice.

DETAILED DESCRIPTION OF THE PREFERRED EMBODIMENT

The method and associated apparatus for installing an above ice surface curling hack will now be described with reference to FIGS. 1 through 3. The apparatus is critically important to the method and will, therefore, be described first.

The preferred embodiment, generally identified by reference numeral 10, is an above ice surface curling hack which will now be described with reference to FIGS. 1 through 3. Referring to FIG. 1, curling hack 10 has two primary components a base member 12 and a detachable foot pad 14. Base member 12 has three sets 16*a*, 16*b*, 16*c* of vertically oriented female receptacles 16. Referring to FIG. 2, foot pad 14 has three depending male members 18.

The method will now be described with reference to FIGS. 1 through 3. Firstly, embed base member 12 into a sheet of ice 20, as illustrated in FIG. 3. It is to be noted that base member 12 is be totally covered by ice thereby leaving ice surface 20 devoid of any hack depressions. Secondly, drill ice out of female receptacles 16 to provide access for mating with depending male members 18 of base member 12. Thirdly, mate female receptacles 16 of base member 12 with depending male members 18 of detachable foot pad 14. Referring to FIG. 1, the appropriate set of female receptacles is chosen depending upon the desired foot positioning. Set 16*a* represents a first position for a left footed curler. Set 16*b* represents a second position for a right footed curler. Set 16*c* represents a central position. The left and right positions have historically been used by curlers and, therefore, curlers have become accustomed to starting their slide from either the right or left side. However, with modern curling a long slide down the centre of the ice surface is viewed as desirable. Central position 16*c* is an optional position. It provides a better starting point for a central slide. It also avoids the necessity of moving foot pad 14 back and forth between set 16*a* and 16*b* to accommodate left footed and right footed curlers. When curling hack 10 is not in use during play or when cleaning the ice, footpad 14 is removed, as illustrated in FIG. 2.

It will be apparent to one skilled in that art that curling hack 10, as described, overcomes the disadvantages of previous above ice surface curling hacks whiles maintaining all the many advantages of an above ice surface curling hack in terms of relative ease of ice maintenance. It will also be apparent to one skilled in the art that modifications may be made to the illustrated embodiment without departing from the spirit and scope of the invention as defined by the claims. For example, the number of male and female members is not critical, as long as foot pad 14 is secured to base member 12 in a stable manner.

The embodiments of the invention in which an exclusive property or privilege is claimed are as follows:

1. A method of installing an above ice surface curling hack, comprising the steps of:

a. firstly, embedding a base member into a sheet of ice, the base member being totally covered by ice thereby leaving a planar ice surface, the base member having at least two vertically oriented female receptacles;

b. secondly, drilling the ice out of the female receptacles; and c. thirdly, providing a detachable foot pad having depending male members and mating the female receptacles of the base member with the depending male members of the detachable foot pad.

* * * * *